US008201381B2

(12) United States Patent
Heath

(10) Patent No.: US 8,201,381 B2
(45) Date of Patent: Jun. 19, 2012

(54) CONCRETE DECK INSERT

(76) Inventor: Richard Heath, Yorba Linda, CA (US)

( * ) Notice: Subject to any disclaimer, the term of this patent is extended or adjusted under 35 U.S.C. 154(b) by 1429 days.

(21) Appl. No.: 11/462,647

(22) Filed: Aug. 4, 2006

(65) Prior Publication Data

US 2007/0095004 A1 May 3, 2007

Related U.S. Application Data

(60) Provisional application No. 60/727,289, filed on Oct. 17, 2005.

(51) Int. Cl.
*E04B 1/00* (2006.01)

(52) U.S. Cl. ..... 52/745.21; 52/745.05; 52/704; 52/699; 52/698

(58) Field of Classification Search ..... 52/698, 52/699, 704, 710, 745.05, 711, 701, 745.21, 52/39, 745.2, 293.3, 295.5; 411/82, 108, 411/80.5, 235, 237, 21; 248/327, 58, 59, 248/62, 317, 342, 343, 222.14, 188.4
See application file for complete search history.

(56) References Cited

U.S. PATENT DOCUMENTS

| | | | | | |
|---|---|---|---|---|---|
| 585,773 | A | * | 7/1897 | Milner | 411/235 |
| 1,088,290 | A | | 2/1914 | McAllister et al. | |
| 1,173,959 | A | * | 2/1916 | Hayes | 411/197 |
| 1,206,601 | A | * | 11/1916 | Schramm | 52/711 |
| 1,510,978 | A | * | 10/1924 | Conklin | 411/400 |
| 3,087,206 | A | * | 4/1963 | Delf et al. | 52/126.5 |
| 3,333,501 | A | * | 8/1967 | Pitcher | 411/531 |
| 3,372,523 | A | * | 3/1968 | Hall, Jr. | 52/699 |
| 3,405,497 | A | * | 10/1968 | McNair | 52/699 |
| 3,450,427 | A | * | 6/1969 | Fischer | 52/513 |
| 3,503,584 | A | * | 3/1970 | Erhart et al. | 249/205 |
| 3,704,034 | A | * | 11/1972 | Shire et al. | 285/47 |
| 3,769,774 | A | * | 11/1973 | Barnes | 52/698 |
| 3,798,866 | A | * | 3/1974 | Werstein | 52/707 |
| 3,843,080 | A | * | 10/1974 | Imai et al. | 248/58 |
| 3,896,599 | A | * | 7/1975 | Werstein et al. | 52/704 |
| 4,007,563 | A | * | 2/1977 | Nakagawa | 52/98 |
| 4,037,384 | A | * | 7/1977 | Molyneux | 52/698 |
| 4,083,162 | A | * | 4/1978 | Regan et al. | 52/699 |
| 4,118,910 | A | * | 10/1978 | McSherry et al. | 52/699 |
| 4,211,048 | A | | 7/1980 | Naka | |
| 4,283,899 | A | * | 8/1981 | Wakamiya | 52/699 |
| 4,325,178 | A | | 4/1982 | Pruehs | |
| 4,422,275 | A | * | 12/1983 | Baetje | 52/509 |

(Continued)

FOREIGN PATENT DOCUMENTS

FR 1132793 3/1957

(Continued)

OTHER PUBLICATIONS

Pipe Hangers Supports and Seismic Bracing; Catalog H-2001; May 10, 2001; pp. 77-79.

(Continued)

*Primary Examiner* — Robert Canfield
*Assistant Examiner* — Matthew Gitlin
(74) *Attorney, Agent, or Firm* — Knobbe, Martens, Olson & Bear, LLP

(57) ABSTRACT

A concrete deck insert has an upper portion and a lower portion that are connected by a threaded coupling. The upper and lower portion are drawn together to clamp onto a portion of a perimeter of a hole.

17 Claims, 8 Drawing Sheets

U.S. PATENT DOCUMENTS

| | | | | | |
|---|---|---|---|---|---|
| 4,557,654 | A | * | 12/1985 | Masuda et al. | 411/431 |
| 4,720,223 | A | * | 1/1988 | Neights et al. | 411/11 |
| 4,854,086 | A | | 8/1989 | Kubsh et al. | |
| 5,205,690 | A | * | 4/1993 | Roth | 411/82 |
| D342,011 | S | | 12/1993 | Maguire | |
| 5,307,602 | A | * | 5/1994 | Lebraut | 52/698 |
| 5,327,696 | A | * | 7/1994 | McBride | 52/745.21 |
| 5,428,936 | A | * | 7/1995 | Roth | 52/704 |
| 5,490,365 | A | * | 2/1996 | Roth | 52/704 |
| 5,568,711 | A | * | 10/1996 | Popp et al. | 52/704 |
| 5,572,838 | A | * | 11/1996 | Truitt et al. | 52/127.2 |
| 5,649,798 | A | * | 7/1997 | Ito | 411/369 |
| 5,727,355 | A | * | 3/1998 | Mitchell | 52/698 |
| 5,733,083 | A | * | 3/1998 | Heminger | 411/82 |
| 5,738,477 | A | * | 4/1998 | McCorkle et al. | 411/509 |
| 5,741,100 | A | * | 4/1998 | Fischer | 411/79 |
| 5,752,795 | A | * | 5/1998 | D'Adamo | 411/429 |
| 5,809,851 | A | | 9/1998 | Thompson | |
| 5,911,664 | A | * | 6/1999 | Masters et al. | 52/698 |
| 5,957,644 | A | * | 9/1999 | Vaughan | 411/82 |
| D425,403 | S | | 5/2000 | Medina | |
| 6,105,332 | A | * | 8/2000 | Boyadjian | 52/698 |
| 6,135,691 | A | * | 10/2000 | Nadarajah et al. | 411/431 |
| 6,240,697 | B1 | * | 6/2001 | Thompson et al. | 52/698 |
| 6,634,151 | B1 | | 10/2003 | Roth | |
| 6,808,350 | B1 | * | 10/2004 | Tooman et al. | 411/431 |
| 6,908,254 | B2 | * | 6/2005 | Atwater et al. | 403/350 |
| 6,986,494 | B2 | * | 1/2006 | Strasser | 248/500 |
| 7,093,400 | B1 | * | 8/2006 | Thompson et al. | 52/698 |
| 7,665,941 | B2 | * | 2/2010 | Wolf et al. | 411/431 |
| 2003/0074857 | A1 | * | 4/2003 | Clapp | 52/699 |
| 2004/0250502 | A1 | * | 12/2004 | Hirokawa et al. | 52/720.1 |
| 2005/0016114 | A1 | * | 1/2005 | Thompson | 52/698 |
| 2005/0204654 | A1 | * | 9/2005 | Fredrickson | 52/169.13 |
| 2006/0016147 | A1 | * | 1/2006 | Johnson | 52/698 |
| 2008/0152459 | A1 | * | 6/2008 | Tooman et al. | 411/372.5 |
| 2009/0272067 | A1 | * | 11/2009 | Gilham | 52/707 |
| 2010/0143068 | A1 | * | 6/2010 | Wolf et al. | 411/374 |
| 2010/0290859 | A1 | * | 11/2010 | Noce et al. | 411/80.6 |

FOREIGN PATENT DOCUMENTS

| | | | | |
|---|---|---|---|---|
| GB | 2203770 | A | * | 10/1988 |
| JP | 03072142 | A | * | 3/1991 |
| JP | 06129021 | A | * | 5/1994 |
| JP | 09296524 | A | * | 11/1997 |
| JP | 09317030 | A | * | 12/1997 |
| WO | 01/69001 | A1 | | 9/2001 |

OTHER PUBLICATIONS

Pipe Hangers Supports and Seismic Bracing; Catalog H-2001; May 10, 2001; pp. 108-109.

Headfirst Products advertisement; Blue Banger Hanger; 2 pages.

General Engineering Catalog; Kin-Line Inc., 1986; 2 pages.

* cited by examiner

CONCRETE DECK INSERT

RELATED APPLICATIONS

This application claims the priority benefit under 35 U.S.C. §119(e) of U.S. Provisional Patent Application Ser. No. 60/727,289, filed Oct. 17, 2005, which is hereby incorporated by reference in its entirety.

BACKGROUND OF THE INVENTION

1. Field of the Invention

The present invention generally relates to anchor components that are assembled in situ within a concrete deck. More particularly, the present invention relates to components used to provide a mounting location for hanging support rods that depend downward from formed concrete decks.

2. Description of the Related Art

Modern buildings often are formed of steel and concrete. In such buildings, hanging support rods are used to support pipes and conduits, automatic sprinkler components, electrical fixtures, and any other apparatus which would normally be depending from a ceiling. Mounting fixtures for these hanging rods are positioned prior to the concrete deck being poured while the building is under construction.

What will be referred to herein as deck construction or decking is a type of construction which is extensively used for forming the floors of large steel or concrete frame buildings of multiple stories. The floor of one level is defined on the upper surface of a given deck while the ceiling of the lower level is defined by the lower surface of the same deck. Two general types of deck construction are in use today in the construction of large buildings: the poured concrete type of deck and the steel floor deck. The steel floor deck is primarily used in large steel frame buildings of multiple stories.

The steel floor deck process features a fluted or corrugated steel sheet that is utilized as a floor base. Utility service conduits are laid in suitable formations on the sheet steel member. There may be outlets for these conduits positioned above the upper surface of the steel sheet. The outlets are identified to be used at a later time. The steel sheet may have openings that allow the conduits and other structures to pass from the top to the bottom of the steel sheet. Once all of the components are properly positioned, a layer of concrete is poured on top of the steel sheet, thereby encapsulating all of the components that are positioned on the steel sheet. Thus, the lower surface of the concrete is in intimate contact with the steel sheet, whose underside is exposed as the ceiling for the lower level. The underside of the steel sheet frequently has a coating sprayed upon it for weather proofing and fire proofing. The resulting deck structure is strong and substantially fireproof.

SUMMARY OF THE INVENTION

While mounting fixtures that accommodate hanging support rods are not new, the present offerings by suppliers have a few drawbacks. For instance, some mounting fixtures are identified as concrete deck inserts. These inserts, which are shown and described in U.S. Pat. No. 6,240,697, issued on Jun. 5, 2001 and entitled Threaded Anchor For Poured Concrete Metal Deck Floors and Wood Frame Floors, feature plastic-based components that are used to secure the insert in position prior to the concrete pour. While such components are usable in some environments, the plastic-based components are prone to deformation in higher temperature environments, such as those encountered during the summer in many parts of the United States. In such environments, the steel sheet often reaches temperatures that can cause the plastic-based components to deform and/or fail. When the plastic-based components deform and/or fail, the inserts may fall over to one side or the other. Accordingly, if not corrected, the hanging support rod will extend out of the concrete deck at an angle because the aperture into which the support rod is mounted is at an angle.

In addition, many construction companies make widespread use of pneumatic and/or electric tools. These tools feature heavy trailing hoses and cords. Once many of the prior deck inserts are mounted in position, workers have to be careful not to allow the hoses and cords to make contact with the installed deck inserts because the deck inserts can be easily broken or dislocated from the installed position.

Furthermore, due to building code regulations, and due to the structure of the steel decking, an insert may be placed very close to a bent portion of the steel decking. In other words, the decking has a corrugated appearance and, due to designed spacing of the inserts, the workers may need to place an insert very close to a bent wall of the steel decking. Prior designs required somewhat significant variance from desired placements.

Thus, a concrete deck insert has been developed that addresses one or more of these and other concerns.

One aspect of the present invention involves a method of securing a concrete deck insert to decking. The concrete deck insert is designed for positioning prior to a concrete pour onto the decking. The insert comprises an upper portion and a lower portion connected by a threaded member. The method comprises placing the insert into an opening formed in the decking with the upper portion positioned above the decking and the lower portion positioned below the decking. The insert is slid to one side of the opening. The upper portion and the lower portion are drawing together with a threaded coupling until the upper portion and the lower portion contact the decking.

Another aspect of the present invention involves a method of installing a deck insert into a section of decking. The deck insert comprises an upper portion and a lower portion. The upper portion comprises a male threaded component, a first female threaded component positioned along the male threaded component and a plate member also positioned along the male threaded component. The lower portion comprises a second female threaded component and a sleeve member positioned over the second female threaded component. The second female threaded component is connected to the male threaded component. The method comprises placing the insert through an opening formed in the decking and separating the upper portion from the lower portion. The insert is slid to one side of the opening and the upper portion and the lower portion are moved together to clamp the decking between the upper portion and the lower portion.

A further aspect of the present invention involves a deck insert. The insert comprises an upper portion and a lower portion that are coupled together by a threaded coupling. The upper portion comprises a plate member and the lower portion comprises a knife-edge. The plate member is positioned between a first female threaded component and the knife-edge such that the plate member and the knife-edge can be forced together by the first female threaded component.

An additional aspect of the present invention involves a deck insert. The insert comprises a male threaded component. A first female threaded component is positioned along the male threaded component. A plate member also is positioned along the male threaded component. A second female threaded component also is positioned along the male threaded component with the plate member positioned between the first and second female threaded components. A sleeve member encases at least a portion of the second female threaded component. The second female threaded component can comprise a retaining nut and a rod coupling. The retaining nut can comprise a raised lip. The raised lip can comprise a knife-edge. The decking will be placed between the knife-edge and the plate member prior to the knife-edge and the plate member being drawn tightly together. The sleeve member preferably has a generally closed end. The generally closed end has one or more slits to define a generally closed access location. The plate member has an eccentrically positioned opening through which the male threaded component extends.

BRIEF DESCRIPTION OF THE DRAWINGS

These and other features, aspects and advantages of the present invention will now be described with reference to the drawings of two preferred embodiments, which embodiments are intended to illustrate and not to limit the invention, and in which figures.

DETAILED DESCRIPTION OF THE PREFERRED EMBODIMENT

Figure 1:
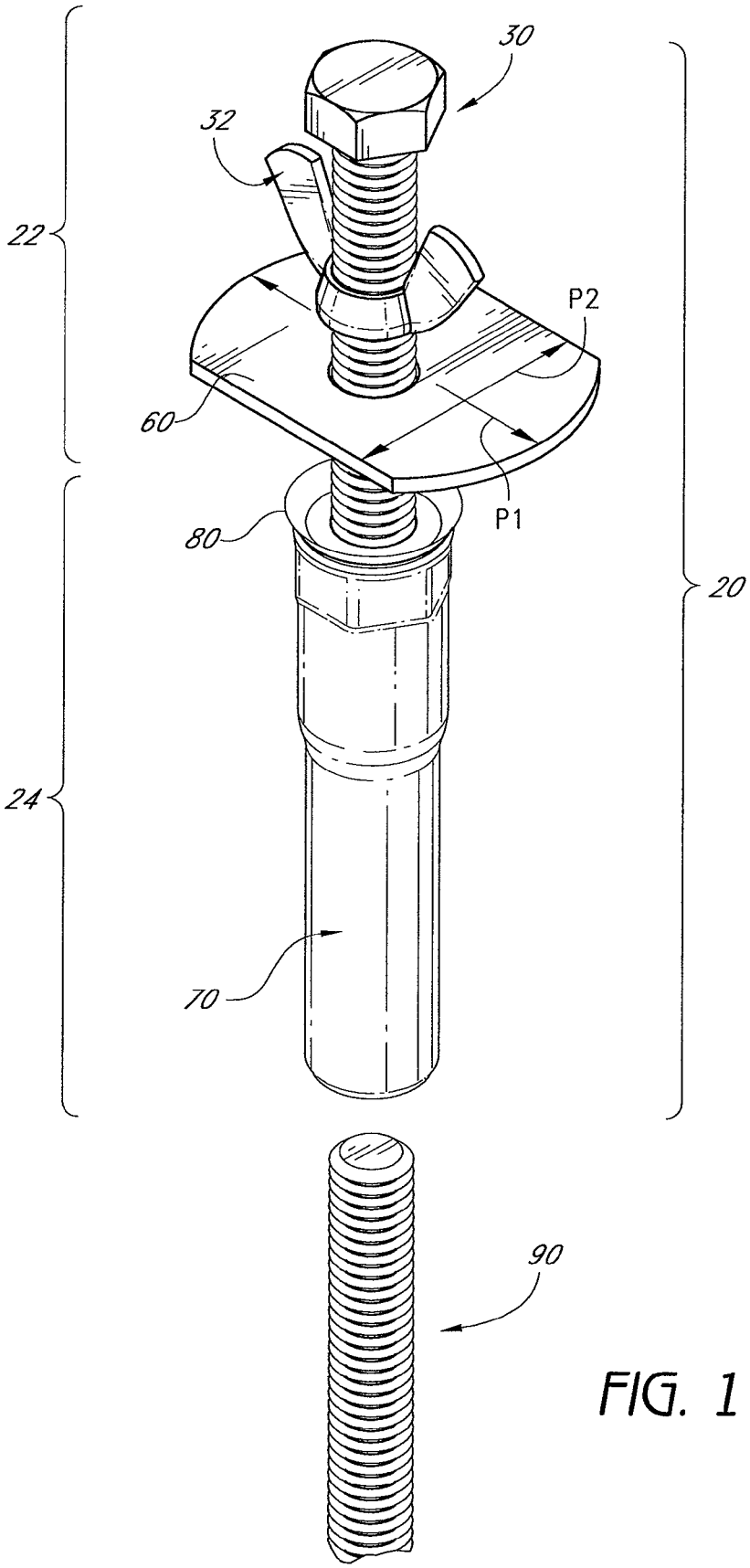
FIG. 1 is a perspective view of a concrete deck insert that is arranged and configured in accordance with certain features, aspects and advantages of the present invention.

With reference initially to FIG. 1, a concrete deck insert assembly 20 is illustrated therein. The assembly 20 is designed for insertion into openings through a metal deck used in forming a concrete deck. The assembly is shown in the context of metal decking but can be used with wooden forms or other suitable manners of forming a concrete decking component.

Figure 2:
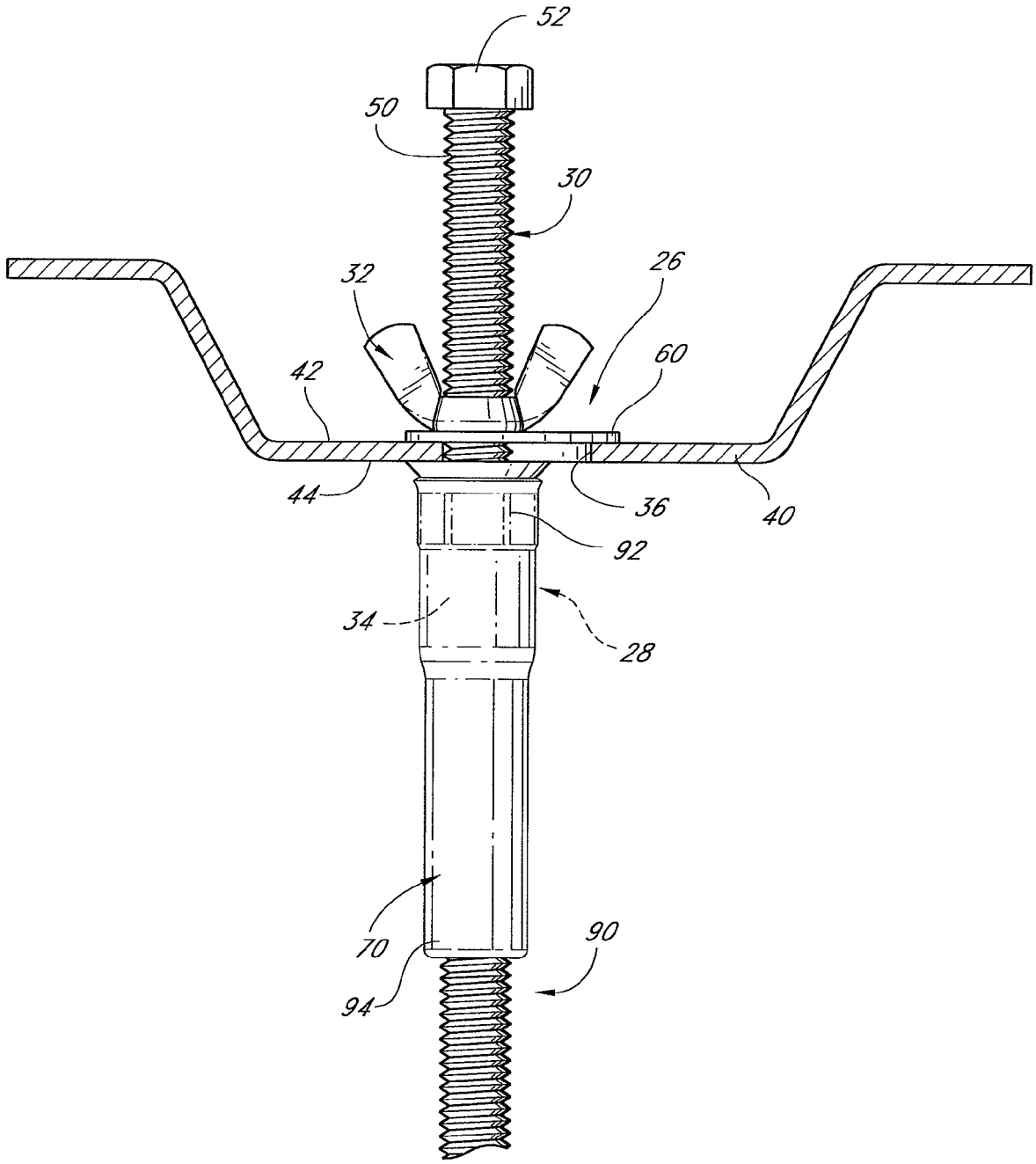
FIG. 2 is a side elevation view of the concrete deck insert of FIG. 1 shown inserted through a cross-section of metal decking.

The assembly 20 comprises an upper portion 22 and a lower portion 24. The upper portion 22 and the lower portion 24 preferably are connected together in a manner that allows a compression load to be created between the two portions 22, 24. With reference to FIG. 2, the upper portion 22 and the lower portion 24 of the illustrated embodiment are connected by a first threaded coupling 26 and a second threaded coupling 28. The first threaded coupling is defined by a male threaded component 30 and a first female threaded component 32 and the second threaded coupling is defined by the male threaded component 30 and a second female threaded component 34.

In some configurations, either the first threaded coupling 26 or the second threaded coupling 28 can be replaced by a fixed structure. For instance, in one arrangement, the male threaded component 30 can be welded or integrally formed with the lower portion 24 such that there is no second threaded coupling 28, which is defined in the illustrated embodiment as the connection between the male threaded component 30 and the second female threaded component 34. In another arrangement, the male threaded component 30 may be formed such that an enlarged portion replaces the first female threaded component 32 such that there is no first threaded coupling 26, which is defined in the illustrated embodiment as the connection between the male threaded component 30 and the first female threaded component 32.

With continued reference to FIG. 2, an opening 36 is formed in a section of decking 40. In most configurations, the decking 40 is a metal component having a top surface 42 and a bottom surface 44. The assembly extends through the opening 36. The upper portion 22 of the assembly 20 is positioned such that it will abut upon the top surface 42 proximate the opening 36 and the lower portion 24 of the assembly is positioned such that it will abut upon the bottom surface 44 of the decking 40. The upper portion 22 and the lower portion 24 squeeze the decking 40 with a compressive force that increases as one or both of the first and second threaded couplings 26, 28 are tightened. Thus, means for clamping the decking can be defined by one or more female threaded components and the male threaded component that together urge the upper and lower portions together.

Figure 3:
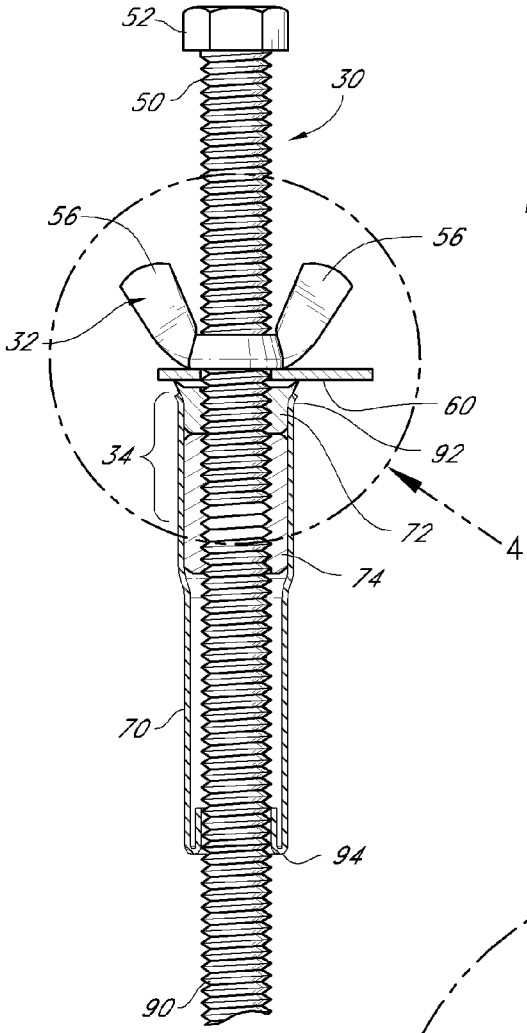
FIG. 3 is a sectioned view of the concrete deck insert of FIG. 1 with an upper threaded member and a lower threaded member shown without sectioning for clarity.

With reference now to FIG. 3, the assembly 20 illustrated therein will be described in further detail. As illustrated, the male threaded component 30 preferably has a main body 50 that is at least partially threaded and the male threaded component 30 preferably also has an enlarged portion 52. In the illustrated arrangement, the main body 50 is completely threaded and the enlarged portion 52 is defined at one end as a hex head. Thus, the illustrated male threaded component 30 is a hex head bolt. As described above, in some configurations, the main body 50 will not be fully threaded.

Figure 5:
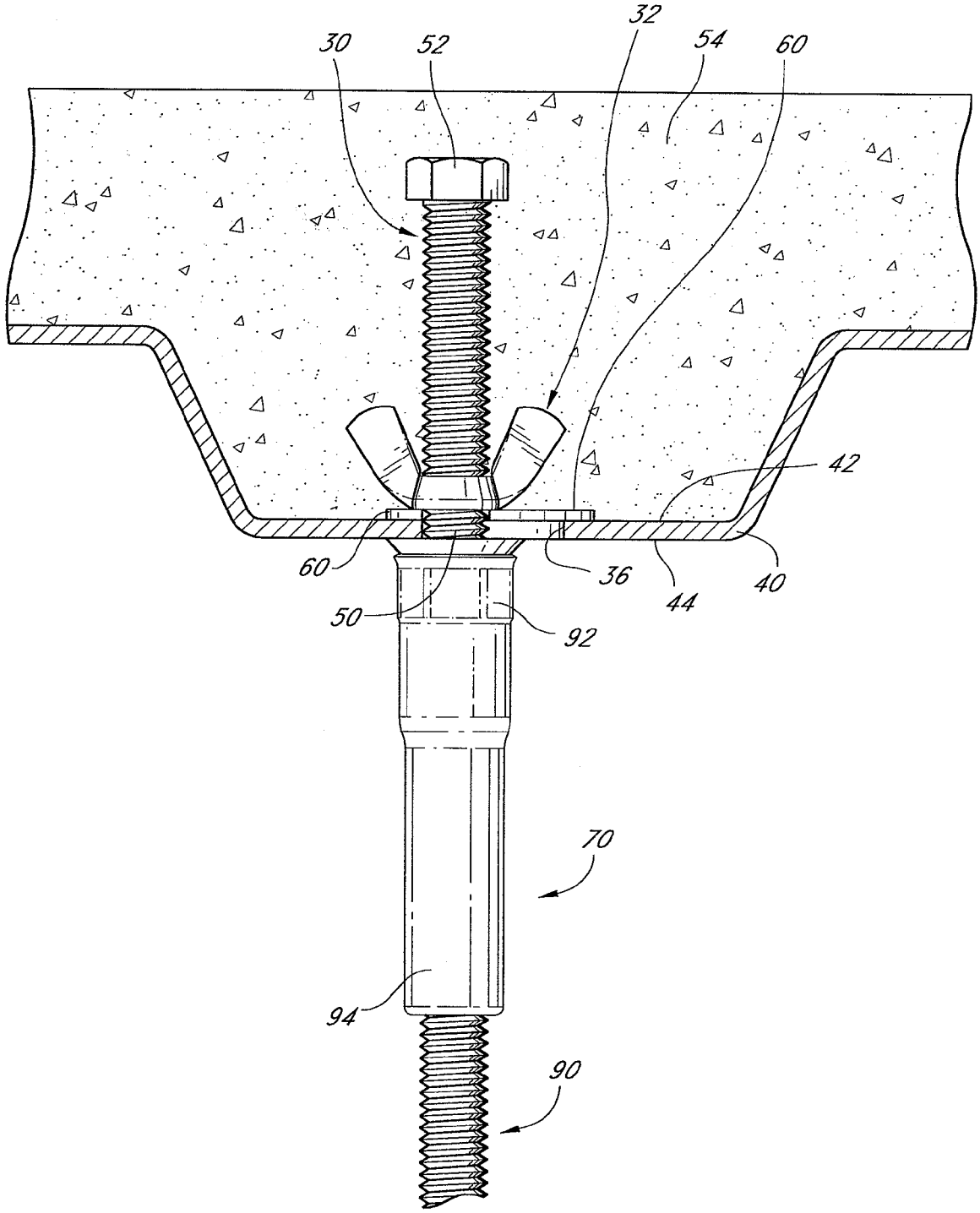
FIG. 5 is a view similar to that of FIG. 2 with a layer of concrete poured over the metal decking.

The enlarged portion 52, as shown in FIG. 5, will be encased by concrete 54. Thus, the enlarged portion 52 provides rotational stability and axial stability to the male threaded component 30 once the concrete 54 encases the enlarged portion. For this reason, the enlarged portion can have any suitable shape. In some configurations, the enlarged portion can be square in cross-section, triangular in cross-section or any other suitable shape. In other less advantageously configurations, the enlarged portion 52 can be circular in cross-section, spherical or the like. In useable but even less advantageous configurations, the enlarged portion can be omitted. Advantageously, however, the illustrated embodiment makes use of readily available components, like hex head bolts, such that costs can be minimized and supplies can be readily obtained.

With continued reference to FIG. 3, the first female threaded component 32 is shown as a nut. More particularly, the illustrated first female threaded component 32 is a wing nut. The illustrated wing nut is advantageous because it allows easy finger tightening of the component 32 on the job site. While a forged wing nut is illustrated, stamped wing nuts and washer-based wing nuts also can be used. In some less advantageous configurations, other types of nuts can be used, including but not limited to square nuts, hex nuts, k-lock nuts, serrated hex flange nuts and the like. More over, non-standardized components can be used as the first female threaded component 32 but such non-standardized components tend to increase the manufacturing costs.

Figure 6:
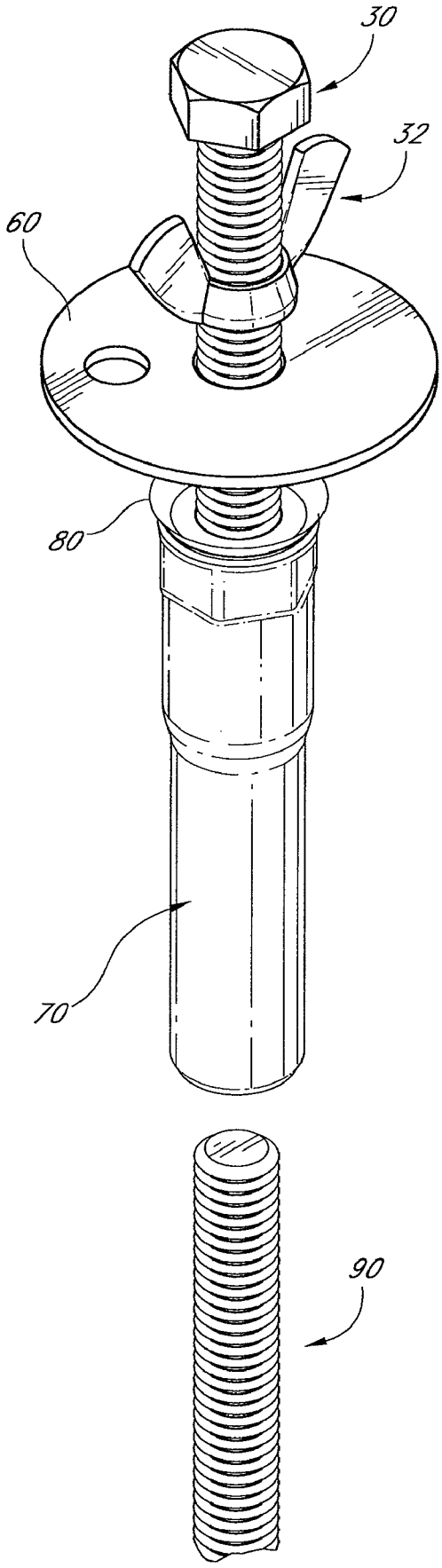
FIG. 6 is a perspective view of the concrete deck insert of FIG. 1 featuring a second embodiment of a plate member.
Figure 7:
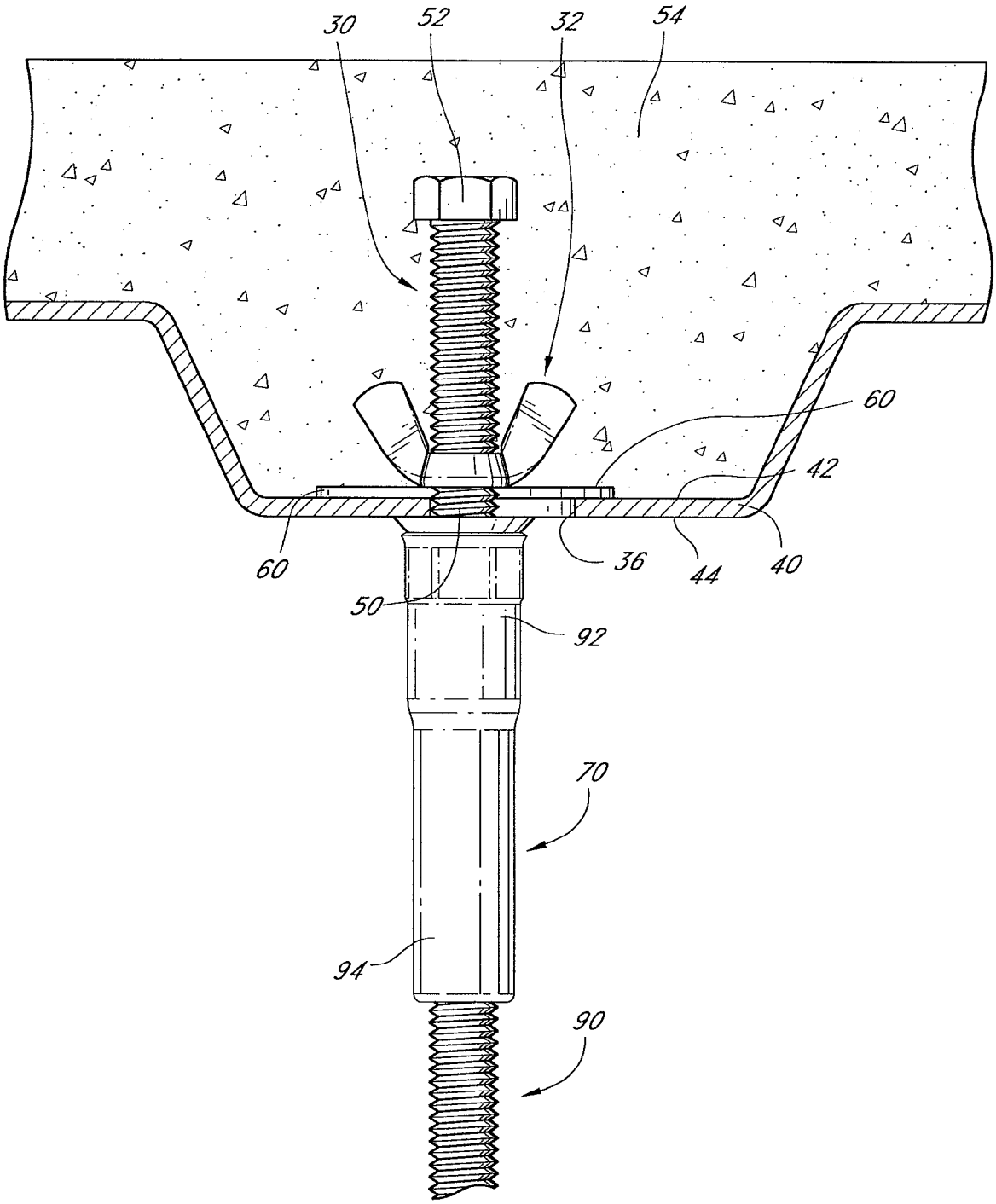
FIG. 7 is a view similar to the view of FIG. 5 showing the configuration of FIG. 6.

With reference still to FIG. 3, the illustrated upper portion 22 further comprises a plate member 60. The plate member 60 is positioned between the first female threaded component 32 and the upper surface 42 of the decking 40. The plate member 60 can have any suitable configuration. In the illustrated assembly 20, the plate member 60 is formed from a fender washer. In particular, the plate member 60 is formed by nipping portions of the fender washer such that the plate member 60 has a first dimension P1 in a first direction and a second dimension P2 in a second direction, which is perpendicular to the first direction and which second dimension P2 is smaller than the first dimension P1. By reducing the second dimension P2, the assembly 20 can be positioned closer to an upstanding portion of the decking 40. Of course, only one side of the plate member 60 can be reduced or the plate member 60 can comprise an offset opening, as better shown in FIG. 6. Such a configuration, however, reduces the ability to simply modify a readily available component, such as a fender washer because, with the addition of an offset opening, the center opening of a standard fender washer is less desirable because of the possible leakage of concrete during the concrete pour. Thus, while it is possible to use a fender washer with a second, offset opening, such a configuration is less desired.

The smaller second dimension P2 of the plate member 60 of FIG. 1 preferably is sufficiently large that the entire diameter of the opening 36 in the decking is covered even when the male threaded component 30 is completely offset to one side of the opening 36. Thus, if the male threaded component 30 has an outer diameter of OD and the opening 36 has an inner diameter of ID, P2≧2(ID-OD) so long as P2 is symmetrically disposed about the male threaded component 30. In some configurations, such as that illustrated, however, the hole that receives the male threaded component 30 is not completely centered or the amount of material removed from each side of the fender washer is different from the other. Other configurations and sizing also can be used.

Figure 4:
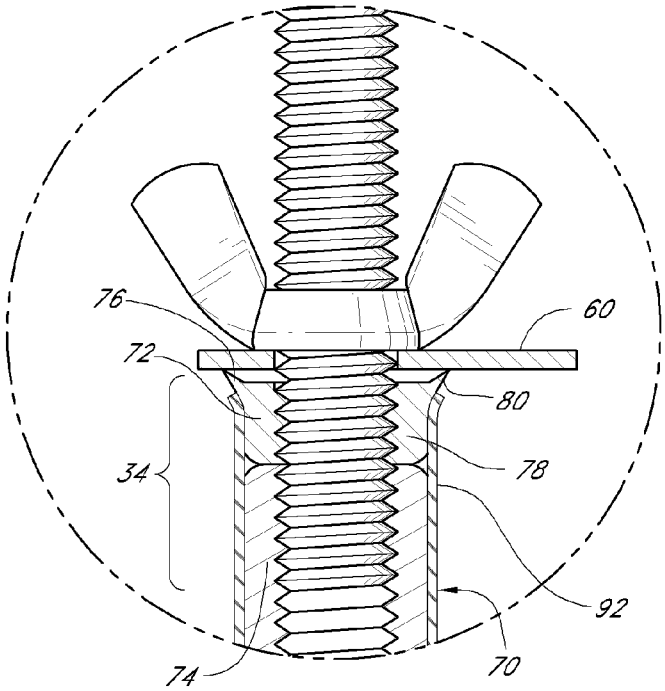
FIG. 4 is an enlarged view of a portion of FIG. 3.

With reference again to FIG. 3 and additional reference to FIG. 4, the lower portion 24 comprises the second female threaded component 34 and a sleeve member 70. In the embodiment shown in FIG. 3, the second female threaded component 34 is formed from two separate components: a retaining nut 72 and a rod coupling 74. These two components 72, 74 can be joined together in any suitable manner or left separable and connected by the sleeve member 70. In some configurations, a single integrated component can replace both of the components 72, 74 but, again, such a custom component disadvantageously increases manufacturing costs.

Figure 8:
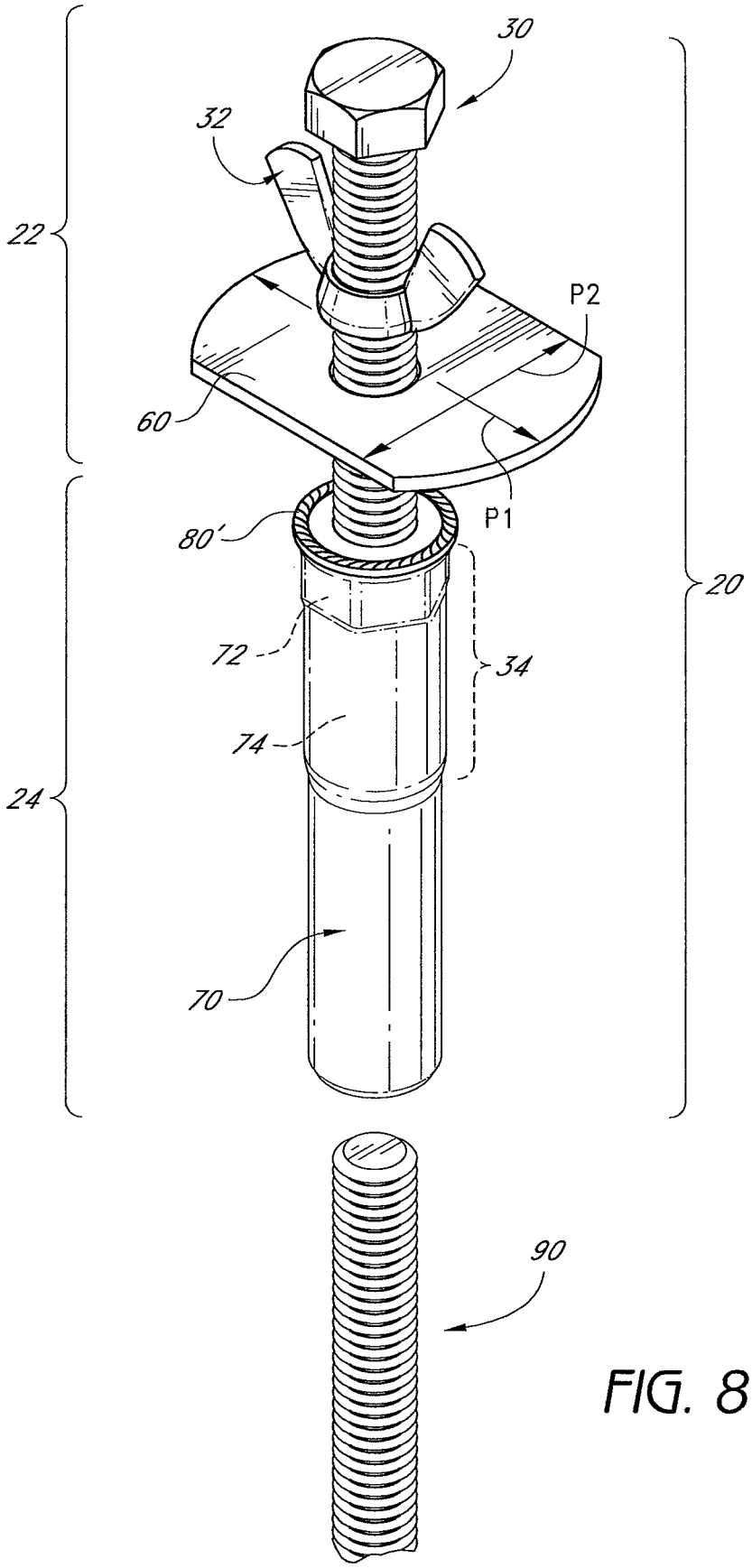
FIG. 8 is a perspective of another embodiment of a concrete deck insert that is arranged and configured in accordance with certain features aspects and advantages of the present invention.
Figure 9:
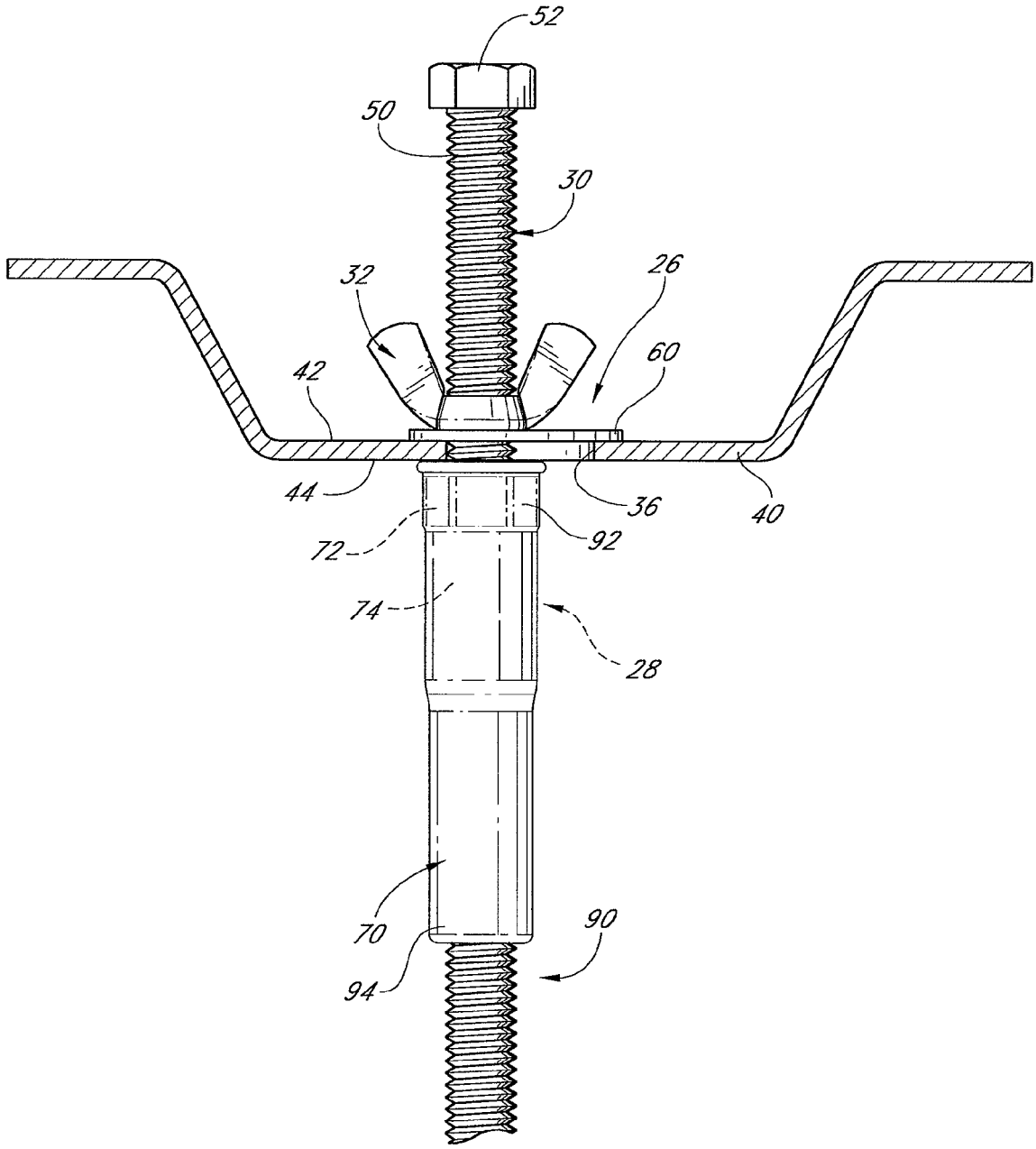
FIG. 9 is a side elevation view of the concrete deck insert of FIG. 8 shown inserted through a cross-section of metal decking.

With continued reference to FIG. 4, the illustrated retaining nut 72 generally comprises a flange portion 76 and a base portion 78. The two portions 76, 78 preferably are integrally formed. In one configuration, the retaining nut 72 does not have internal threaded; however, in the illustrated configuration, the retaining nut 72 is internally threaded. Thus, the illustrated base portion 78 is advantageously configured as a hex nut. In some configurations, the base portion 78 can have other configurations, such as a square, a triangle, a cylinder and the like. The illustrated flange portion 76 extends upward and outward from the base portion. Other configurations also are possible. In one particularly preferred configuration, the flange portion 76 forms a knife-edge 80 (see FIG. 4). The knife-edge 80 is not necessarily sharpened to a cutting edge but preferably is capable of at least scoring the surface of the decking 40 when the assembly is clamped into place on the decking 40. In one configuration, the knife-edge 80 can be replaced by a locking surface 80' (see FIGS. 8 and 9) that is somewhat flattened and provided with serrations. The serrations reduce the likelihood of slippage along the edge of the hole 36 if the hole 36 has a jagged edge or the like remaining from formation.

The rod coupling 74 provides a receiver for a lower end of the male threaded component 30 and for an upper end of a hanger rod 90 or the like. The rod coupling 74 has a sufficient length to allow a suitable number of threads to be received from each of the male threaded component 30 and the hanger rod 90. In some configurations, the rod coupling 74 has a single thread pattern throughout its length and, in other configurations, the rod coupling 74 has an interrupted thread pattern that limit the extent to which a rod can enter either end. Moreover, in some configurations, the same size threaded member is provided for at both ends and, in other configurations, different size threaded members can be used at either end. In yet other configurations, a stepped diameter bore can be provided such that different diameters of hanger rods 90 can be accommodated. Such configurations, however, disadvantageously increase the length of the rod coupling 74.

As described above, the sleeve member 70 encases the rod coupling 74 and the retaining nut 72. The sleeve member 70 preferably is formed of a vinyl or rubber material. Prior to insertion of the hanger rod 90, the sleeve member 70 has a generally open end 92 and a substantially closed end 94. The substantially closed end 94 can be provided with slits that allow the insertion of the hanger rod 90 through the substantially closed end 94 while maintaining the substantially closed end 94 generally closed until the hanger rod 90 is inserted. In one preferred arrangement, the slits form a cross. In this manner, if a surface treatment is sprayed onto the bottom surface 44 of the decking 40 after the assembly 20 is installed, the internal threads of the lower portion 24 will be substantially protected from materials that may otherwise hinder installation of the hanger rod 90 or the like.

With reference to FIGS. 2 and 5, the assembly 20 can be installed into a suitably formed opening. Generally, the holes 36 formed in the decking 40 are not smooth due to the manner in which the holes are formed. Thus, the illustrated assembly 20 is dropped into the hole 36 with the substantially closed end 94 entering the hole first and with a sufficient spacing between the plate member 60 and the knife-edge 80 being provided by the location of the first female threaded component. The upper portion 22 and the lower portion 24 should be separated. With the knife-edge 80 lower than the bottom surface 44 of the decking 40 and the plate member 60 higher than the top surface 42 of the decking, the assembly can be slid to one side of the hole 36 until the male threaded component 30 contacts the side of the decking that defines the hole 36. With the assembly positioned to one side of the hole 36 and the plate member 60 covering all or substantially all of the hole 36, the first threaded component 32 can be tightened. In one preferred configuration, only a portion of the periphery of at least one of the upper portion 22 and the lower portion 24 actually contacts the corresponding upper or lower surface 42, 44 of the decking 40. In one particularly preferred configuration, only a portion of the periphery of the lower portion 24 contacts the lower surface 44 of the decking 40. As the assembly 20 is clamped onto the decking 40, the knife-edge 80 of the lower portion 24 preferably bites into the decking 40 to provide a very secure connection between the assembly 20 and the decking 40. The secure connection reduces the likelihood that hoses or cords will displace the assembly 20 while preparation for the concrete pour continues.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A method of securing a concrete deck insert to decking, which concrete deck insert is designed for positioning prior to a concrete pour onto the decking, the insert comprising an upper portion and a lower portion connected by a threaded member; the method comprising:

placing said insert into an opening formed in the decking with said upper portion positioned above the decking and said lower portion positioned below the decking;

sliding said insert to one side of the opening; and then drawing said upper portion and said lower portion together with a threaded coupling until said upper portion contacts the decking, and said lower portion contacts only said one side of the opening.

2. The method of claim 1, wherein said upper portion comprises a male threaded component and a first female threaded component and said lower portion comprises a second female threaded component and wherein drawing said upper portion and said lower portion together comprises moving said first female threaded component and said second female threaded component together along said male threaded component.

3. The method of claim 2, wherein said first female threaded component is moved toward said second female threaded component and said second female threaded component remains stationary relative to said male threaded component.

4. The method of claim 1, wherein said upper portion comprises a plate member and said plate member is rotated to a desired position prior to sliding said insert to one side of the opening.

5. The method of claim 4, wherein said upper portion further comprises a male threaded member and a first female threaded member, said plate member being positioned below said first female threaded member, and wherein drawing said upper portion and said lower portion together comprises moving said first female threaded component along said male threaded member toward said plate member.

6. The method of claim 1, wherein said upper portion comprises a plate member and said method further comprises substantially covering the opening with said plate member.

7. The method of claim 6, wherein said upper portion further comprises a male threaded member and a first female threaded member, said plate member being positioned below said first female threaded member, and wherein drawing said upper portion and said lower portion together comprises moving said first female threaded component along said male threaded member toward said plate member.

8. The method of claim 1 further comprising inserting a hanger rod into said lower portion.

9. A method of installing a deck insert into a section of decking, said deck insert comprising an upper portion and a lower portion, said upper portion comprising a male threaded component, a first female threaded component positioned along said male threaded component and a plate member also positioned along said male threaded component, said lower portion comprising a second female threaded component and a sleeve member positioned over said second female threaded component, said second female threaded component connected to said male threaded component, the method comprising:

placing said insert through an opening formed in the decking;

separating said upper portion from said lower portion;

sliding said insert to one side of the opening; and then moving said upper portion and said lower portion together to clamp the decking between said upper portion and said lower portion and wherein said lower portion contacts only said one side of the opening.

10. The method of claim 9, wherein said insert is slid to one side of the opening until said male threaded component contacts said one side of the opening.

11. The method of claim 9, wherein moving said upper portion and said lower portion together comprises moving said first female threaded component and said second female threaded component together along said male threaded component.

12. The method of claim 11, wherein said first female threaded component is moved toward said second female threaded component and said second female threaded component remains stationary relative to said male threaded component.

13. The method of claim 9, wherein said plate member is rotated to a desired position prior to sliding said insert to one side of the opening.

14. The method of claim 13, wherein moving said upper portion and said lower portion together comprises moving said first female threaded component along said male threaded member toward said plate member.

15. The method of claim 9 further comprising substantially covering the opening with said plate member.

16. The method of claim 15, wherein moving said upper portion and said lower portion together comprises moving said first female threaded component along said male threaded member toward said plate member.

17. The method of claim 9 further comprising inserting a hanger rod into said lower portion.

* * * * *